United States Patent [19]

Eichelberger et al.

[11] 4,380,749

[45] Apr. 19, 1983

[54] ONE-TIME ELECTRICALLY-ACTIVATED SWITCH

[75] Inventors: Charles W. Eichelberger, Schenectady; Robert J. Wojnarowski, Clifton Park, both of N.Y.

[73] Assignee: General Electric Company, Schenectady, N.Y.

[21] Appl. No.: 220,343

[22] Filed: Dec. 29, 1980

[51] Int. Cl.[3] ..... H01C 13/00

[52] U.S. Cl. ..... 338/215; 431/359

[58] Field of Search ..... 338/20, 21, 215, 223, 338/314; 200/2; 337/413; 362/4, 6, 13, 14, 15; 431/359

[56] References Cited

U.S. PATENT DOCUMENTS 3,996,066 7/1976 Smielek et al. ..... 431/359

4,144,418 3/1979 Girard et al. ..... 200/2

*Primary Examiner*—C. L. Albritton

*Attorney, Agent, or Firm*—Geoffrey H. Krauss; James C. Davis, Jr.; Marvin Snyder

[57] ABSTRACT

A one-time electrically-activated switch is composed of a cured polymeric binder which contains a powdered conductive material in an amount sufficient to establish particle-to-particle contact throughout the binder and in which the material powder particles have a non-conductive oxide surface sufficient to resist the flow of electricity below a given threshold. When a sufficiently high voltage is applied to the switch, the break-down voltage of the oxide layer is exceeded and avalanche current is permitted to flow. As a result, the oxide layer on the conductive particles breaks down along the break-down path and forms an irreversible low-impedance connection.

14 Claims, 2 Drawing Figures

ONE-TIME ELECTRICALLY-ACTIVATED SWITCH

Related applications include Serial Nos. 220,331; 220,341; 220,342; 220,344; and 220,937 all filed Dec. 29, 1980; and 220,332 having a filing date of Mar. 11, 1981.

BACKGROUND OF THE INVENTION

The present application relates to switching elements and, more particularly, to a novel electrically-activated one-time switch.

It is often desirable to have discretionary control of the paths interconnecting logic circuitry, i.e., to have the equivalent of an electrically-programmable jumper. For example, an addressably-controlled circuit may be required to have twelve individual addresses. The addresses could be provided by switches, except that the cost of the twelve switches would amount to approximately one-third the cost of the total system. Additionally, such switches must be set by hand and cannot be established by automated machinery. It is clearly desirable to have available an electrically-programmable jumper which can be substituted for jumper wires in all applications where the latter are used. There has not, however, been a method known heretofore to supply an electrically-programmable jumper which has a capability of withstanding logic level voltages, while being programmable at a voltage level which is not significantly higher.

BRIEF SUMMARY OF THE INVENTION

In accordance with the invention, a one-time electrically-activated switch or jumper comprises a cured polymeric binder containing an agglomeration of particles of a conductive material with the particles having a surface normally coated with a layer of a non-conductive compound of the conductive material, the agglomeration present in an amount sufficient to establish particle-to-particle contact throughout the binder. Presently preferred materials have a surface oxide sufficient to resist the flow of electricity before a given threshold voltage is applied thereto. A presently preferred conductive material is aluminum, although other materials, such as chromium and the like, can be equally as well utilized. The invention also relates to the method of fabricating such a switch and the method of its operation.

It is, accordingly, an object of this invention to provide an electrically-actuated switch or jumper which: can be batch fabricated by suitable techniques, such as by screen printing techniques and the like; will have a reliable threshold voltage above which programming will occur and below which the device can be continuously operated without damage; can be used as a one-time-only protection arrangement for sensitive devices, i.e., to provide a protective function like a fuse with a reverse operational function; and will have a sufficiently low cost such that its replacement can be tolerated. A further object of the invention is to provide a device which can be fabricated as an integral part of a thick film circuit or other type of printed circuit.

These and other objects of the invention will become apparent to those skilled in the art from the following detailed description, when read in conjunction with the drawings.

DESCRIPTION OF THE INVENTION

Figure 1:
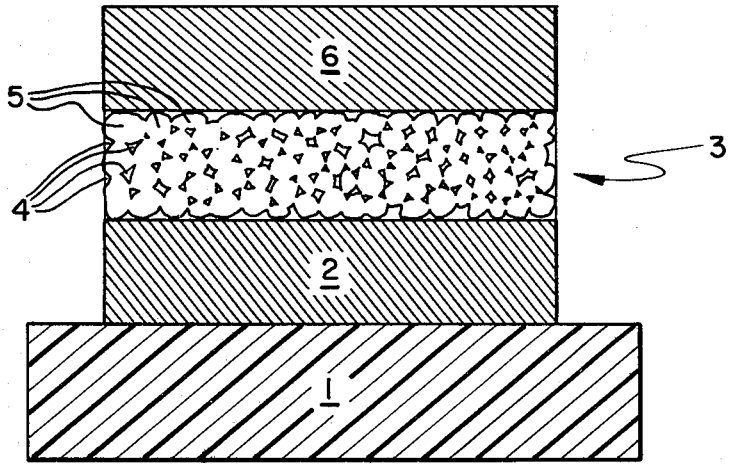
FIG. 1 is a cross-sectional view of a first embodiment of the invention, after conduction has occurred.

In accordance with the present invention, a one-time (or one-shot) electrically-activated switch (or jumper) comprises a cured polymeric binder containing an agglomeration of particles of a conductive material, with the particles having a surface normally coated with a layer of non-conductive compound of the conductive material. A surface oxide is the presently preferred coating. The oxide-covered conductive particles are present in an amount sufficient to establish particle-to-particle contact throughout the binder, and in which the surface oxide is sufficient to resist the flow of electricity before a given threshold voltage is applied thereto. Presently preferred conductive materials include aluminum and chromium, although other conductive materials having a surface coating of non-conductive oxide, sulfide, halide or the like, compound of the conductive material, are all useful in the present invention. The switch is prepared by: combining a curable polymer and the powdered particles (e.g. of aluminum with surface oxide) and, if desired, a solvent; applying the same to a suitable substrate; and thereafter curing the binder.

At least a part of the substrate on which the switch is deposited is a conductor which may be a thick film fired conductor, polymer conductor, printed circuit board conductor or any other type of conductor. The process of the invention is particularly adapted to the use of automatic application techniques, such as that of screen printing and the like, in order to establish the switch on the substrate, although the invention is not so limited. Other types of printing and application techniques can be used including, without limitation, pad flexographic printing, stencil, rotogravure and offset printing. Thus, any convenient method of depositing the switch precursor composition on the substrate can be employed.

The switch precursor composition used in the present invention is a mixture of a finely divided powder with a curable polymer of appropriate viscosity and flow characteristics for the application system contemplated. The viscosity and flow characteristics of the mixture may be controlled by the incorporation of a solvent therein. The powder generally has a particle size of less than about 50 microns, preferably 3 to about 25 microns and most preferably about 15–25 microns. When the switch precursor composition is intended to be deposited by screen printing, the particles must be of a size to pass through the screen. The particles tend to buildup a self-limiting compound (e.g. oxide) film which is an insulator and acts to prevent bulk conductivity. As a consequence, it is not necessary to exercise any particular care to insure that the thickness of the surface oxide is the same for each particle in a given particle batch or from particle batch to particle batch.

The curable polymers employed in the switch precursor composition are any curable material or mixture thereof which exhibits a degree of adhesion to the substrate being employed and to the finely divided powder which is dispersed therein. Typical polymers which can be employed include the homopolymers and copolymers of ethylenically unsaturated aliphatic, alicyclic and aromatic hydrocarbons such as polyethylene, polypropylene, polybutene, ethylene propylene copolymers, copolymers of ethylene or propylene with other olefins, polybutadiene, polyisoprene, polystyrene and polymers of pentene, hexene, heptene, bicyclo(2,2,1)2-heptane, methyl styrene and the like. Other polymers which can be used include polyindene, polymers of acrylate esters and polymers of methacrylate esters, acrylate and methacrylate resins such as ethyl acrylate, n-butyl methacrylate, isobutyl methacrylate, ethyl methacrylate and methyl methacrylate; alkyd resins; cellulose derivatives such as cellulose acetate, cellulose acetate butyrate, cellulose nitrate, ethyl cellulose, hydroxyethyl cellulose, methyl cellulose, and sodium carboxymethyl cellulose; epoxy resins; hydrocarbon resins from petroleum; isobutylene resins; isocyanate resins (polyurethanes); melamine resins such as melamine-formaldehyde and melamineurea-formaldehyde; oleo-resins; polyamide polymers such as polyamides and polyamide-epoxy polyesters; polyester resins such as the unsaturated polyesters of dibasic acids and dihydroxy compounds; polyester elastomer and resorcinol resins such as resorcinol-formaldehyde, resorcinol-furfural, resorcinol-phenol-formaldehyde and resorcinol-urea; rubbers such as natural rubber, reclaimed rubber, chlorinated rubber, butadiene styrene rubber, and butyl rubber, neoprene rubber, polysulfide, vinyl acetate and vinyl alcohol-acetate copolymers, polyvinyl alcohol, polyvinyl chloride, polyvinyl pyrollidone and polyvinylidene chloride, polycarbonates, graft copolymers of polymers of unsaturated hydrocarbons and of unsaturated monomers such as graft copolymers of polybutadiene, styrene and acrylonitrile, commonly called ABS resins, polyamides and the like, and such other material as described in co-pending application Ser. No. 220,342, filed on even date herewith and incorporated herein by reference in its entirety.

The polymers of the present invention can contain various other materials such as inert fillers, e.g., glass fiber, glass powder, glass beads, asbestos, mineral fillers, wood flour and other vegetable fillers, dyes, pigments, waxes, stabilizers, lubricants, curing catalysts such as peroxides, photosensitizers and amines, polymerization inhibitors and the like. It is preferred, but not essential, to employ a polymer which exhibits a substantial degree of volumeric shrinkage upon curing to facilitate particle-to-particle and switch-to-conductor contact.

The amount of finely divided conductive material and polymer is adjusted such that the particles with their non-conductive (oxide) coating are in particle-to-particle contact after curing and, generally, the particles constitute about 60–80% by volume of the mixture after curing. If aluminum is used, the aluminum preferably is about 70% by volume.

A solvent can be used in the switch precursor composition, if desired, in order to adapt the viscosity and flow characteristics for the type of printing or other application technique desired. In general, the solvent should be employed in an amount sufficient that the precursor composition has a viscosity of 15,000–200,000 cps at room temperature and preferably about 50,000–150,000 cps. Suitable solvents or diluents can be aliphatic or aromatic and usually contain up to about 30 carbon atoms. They include the hydrocarbons, ethers and thioethers, carbonyl compounds such as esters and ketones, nitrogen containing compounds such as amides, amines, nitriles and nitro compounds, alcohols, phenols, mercaptans and halogen containing compounds. Examples include alcohols such as methanol, ethanol, propanol, benzyl alcohol, cyclohexanol, ethylene glycol, glycerol and the like, aromatic materials such as benzene, toluene, xylene, ethyl benzene, naphthalene, tetralin and the like, ethers such as methyl ether, ethyl ether, propyl ether, methyl t-butyl ether, and the like, alkanes such as methane, ethane, propane and the like, dimethyl sulfoxide, butyl formate, methyl acetate, ethyl acetate, formamide, dimethyl formamide, acetamide, acetone, nitrobenzene, monochlorobenzene, acetophenone, tetrahydrofuran, chloroform, carbon tetrachloride, trichloroethylene, ethylbromide, phenol, mercaptophenol, and the like. Additionally, reactive solvents or diluents such as triallyl isocyanurate can be used if desired. It is preferred to employ a solvent which is relatively nonvolatile at room temperature so that the viscosity and flow of the ink is appropriate during application to the substrate and highly volatile at the curing temperature of the polymer or at other temperatures above the application temperature. The carbitol series of solvents and particularly butyl carbitol (diethylene glycol monobutyl ether) has been found to be particularly appropriate.

The switch precursor composition is applied to the substrate to achieve the desired switch patterns thereon. For example, standard printed circuit application technology can be employed. Any temperature which will not cause premature curing of the composition and at which the viscosity and flow characteristics of the composition are appropriate to the application technique used can be employed. It is preferred, but not necessary, to permit at least a portion of the solvent to evaporate after application of the precursor composition to the substrate and before curing in order to facilitate the curing reaction. Preferably, the drying is effected for 0.1–1 hour, more preferably about 0.25–0.5 hour, at a temperature of about 70°–150° C., most preferably about 110°–130° C.

In the next step in the instant process, the precursor polymer is cured or polymerized by the most convenient method. If an autocatalyst has been added, the polymer will cure by itself with no additional initiation. In the case of ultraviolet light initiators, the substrate carrying the switch precursor composition can be passed under a high intensity ultraviolet source which causes the initiators to begin the curing reaction. Whatever technique is employed, it should not result in breaking down the nonconductive (e.g. oxide) coating on the conductive material (e.g. aluminum) particles. It is presently preferred to employ a thermal curing system which is activated by exposure to temperatures of about 140°–200° C., preferably about 150°–180° C., for a time of 0.1–1 hour, preferably 0.15–0.5 hour. As a result of this step, a closely compacted powder (of aluminum, chromium or the like) bound to the substrate by the cured polymer is achieved. Because of the non-conductive (e.g. oxide) coating, the switch composition after curing is not conductive until a given threshold voltage is applied thereto.

A suitable conductor is overlaid on the switch polymer, which itself overlies another conductor. The switch polymer functions as a dielectric at this time due to the nonconductive (e.g. oxide) coating. If a voltage is applied between the two conductors, an electrostatic field is established across each of the non-conductive surface layers of the individual conductive particles. As long as the applied voltage remains below a fixed value, the resistance between the two conductors is essentially infinite thereby preventing the flow of current. However, when the break-down field of the non-conductive coating of the particles is exceeded, an avalanche current flows and the particles are welded together along the resultant path. It has been found that the breakdown voltage depends essentially on the thickness of the dielectric layer, which will determine how many particles will be in series in terms of a given electric field. As may be expected, there is some effect due to the magnitude of the concentration of the conductive particles in the cured polymer, the type of the cured polymer employed, etc., but the primary determining factor of break-down voltage is thickness. When a given voltage switch is desired, the appropriate thickness can be readily established by a few simple laboratory experiments. It will also be appreciated that to some extent, the magnitude of the voltage applied in breaking down the non-conductive surface layer will affect the resistance of the resulting conductive pathway.

Two different types of switch configurations are shown in the FIGS. The configuration of FIG. 1 shows an insulator substrate 1 carrying a conductor 2 having the entire top surface thereof overlayed with a switch layer 3 of the present invention. Switch layer 3 is composed of a polymeric binder 4 and conductive particles 5. The switch layer 3 is covered on its upper surface by a second conductor 6. In this embodiment, any portion of the entire volume of switch layer 3 can become conductive after a break-down voltage has been applied.

Figure 2:
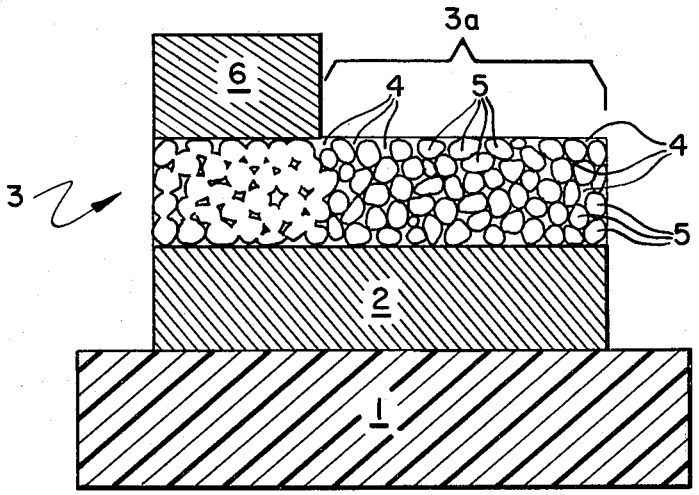
FIG. 2 is a cross-sectional view of a second embodiment of the invention, after conduction has occurred.

The embodiment shown in FIG. 2 is similar to that of FIG. 1 except that the upper conductor 6 overlies only a portion of the upper surface of switch layer 3. Application of a break-down field has caused an avalanche current, welding together the particles between conductor 6 and conductor 2; the non-conductive coating of the particles in layer portion 3*a*, which are not between the two conductors, remains substantially intact. Thus, in this embodiment, the area of switch layer 3 on the left-hand side of the figure is electrically conductive, while the switch layer portion 3*a*, on the right-hand side, remains as a dielectric material. This feature of the invention permits application techniques which do not have a very high degree of precision and registration to be employed without undue concern.

In order to demonstrate the present invention, a switch precursor composition was prepared containing 30 g of a 60:40 weight percent mixture of an unsaturated polyester and styrene, 3 g of diallylphthalate and 67 g of −325 mesh aluminum powder. The precursor composition was spread over a printed circuit board and thermally cured. Thereafter, dots of conductive material were applied to the cured switch composition. It was determined that the switch layer, which had a thickness of approximately 3 mils, could withstand application of 5 volts without becoming conductive. The various dots of conductive material were then programmed with voltages which varied from 8 to 15 volts and it was found that all of the switch layer areas between the printed circuit board and the associated conductive dot had become conductive, with resistances that varied between 2 and 10 ohms depending on the programmed voltage applied. It will be appreciated that the switch just described is a direct analog of a reverse fuse in that it can be reliably programmed from a high impedance to a low impedance condition.

Various changes and modifications can be made in the process and products of this invention without departing from the spirit scope thereof. The various embodiments which have been disclosed herein were for the purpose of further illustrating the invention but were not intended to limit it.

We claim:

1. A one-time electrically-activated switch, comprising: a polymeric binder containing an agglomeration of particles of a conductive material, essentially all of said particles having a surface normally coated with a layer of an oxide compound of the conductive material, said conductive material being present in an amount sufficient to establish particle-to-particle contact throughout the binder, the oxide surface and the thickness of said binder being sufficient to resist the flow of electricity before a given threshold voltage of between about 8 volts and about 15 volts is applied thereto.

2. The electrically-activated switch of claim 1 wherein the cured polymeric binder comprises an unsaturated polyester.

3. The electrically-activated switch of claim 1 wherein said conductive material comprises about 60–80% of said binder and said particles therein,.

4. The electrically-activated switch of claim 3 wherein said conductive material comprises aluminum and constitutes about 70% of said binder and said particles therein, by volume.

5. The electrically-activated switch of claim 1, further including a conductor in contact therewith.

6. The electrically-activated switch of claim 1 further including a pair of conductors, said switch being disposed between said conductors.

7. The electrically-activated switch of claim 6 having at least one pathway between said conductors wherein the oxide compound on said particles has been broken down to a resistance not greater than 10 ohms, so as to permit the flow of current through said pathway.

8. The electrically-activated switch of claim 1, wherein said conductive material comprises aluminum.

9. The electrically-activated switch of claim 1, wherein said conductive material comprises chromium.

10. An irreversibly-activated electrical switch comprising: a polymeric binder containing an agglomeration of particles of a selected one of aluminum and chromium, essentially all of said particles having a surface normally coated with a layer of a non-conductive compound of the selected one of aluminum and chromium, said particles being present in an amount to establish particle-to-particle contact throughout the binder, the surface non-conductive compound on a portion of said particles being at least partially broken down so as to provide at least one low resistance pathway through said binder.

11. The irreversibly-activated switch of claim 10, wherein said portion of said particles are welded together.

12. The irreversibly-activated electrical switch of claim 10 or 11 further including a pair of conductors, said switch being disposed between two conductors such that the low resistance pathway electrically interconnects said two conductors.

13. A method for operating a one-time electrically-activated switch having a polymeric binder containing an agglomeration of particles of a conductive material, the particles having a surface normally coated with a layer of an oxide compound of the conductive material, the conductive material being present in amounts sufficient to establish particle-to-particle contact throughout the binder and with the oxide surface being sufficient to resist the flow of electricity before a given threshold breakdown voltage between about 8 volts and about 15 volts is applied thereto, said method comprising the step of: applying a voltage to the switch in excess of the about 8 volt to about 15 volt threshold breakdown voltage thereof.

14. A method of operating a one-time electrically-activated switch disposed between a pair of conductors, the switch having a polymeric binder containing an agglomeration of particles of a conductive material, the particles having a surface normally coated with a layer of an oxide compound of the conductive material, the conductive material being present in an amount sufficient to establish particle-to-particle contact throughout the binder and with the oxide surface being sufficient to resist the flow of electricity before a given threshold break-down voltage between about 8 volts and about 15 volts is supplied thereto, comprising the step of: applying a voltage to the switch in excess of the threshold break-down voltage thereof.

* * * * *